United States Patent [19]

Ross

[11] Patent Number: 4,574,508

[45] Date of Patent: Mar. 11, 1986

[54] TELESCOPE SIGHT MOUNT

[75] Inventor: Cecil J. Ross, El Paso, Tex.

[73] Assignee: Omark Industries, Portland, Oreg.

[21] Appl. No.: 513,881

[22] Filed: Jul. 14, 1983

[51] Int. Cl.[4] ..... F41G 1/38

[52] U.S. Cl. ..... 42/1 ST; 33/245

[58] Field of Search ..... 42/1 ST; 33/245-250

[56] References Cited

U.S. PATENT DOCUMENTS

| | | | |
|---|---|---|---|
| D. 257,564 | 11/1980 | Weast et al. | D22/7 |
| D. 259,204 | 5/1981 | Weast | D22/7 |
| 2,018,960 | 10/1935 | Kuhn | 42/1 ST |
| 2,449,551 | 9/1948 | Garand | 42/1 ST |
| 2,641,057 | 6/1953 | Moore | 42/1 ST |
| 2,743,526 | 5/1956 | Ivy | 42/1 ST |
| 3,253,361 | 5/1966 | Kingsbury | 42/1 ST |
| 3,362,074 | 1/1968 | Luebkeman et al. | 33/52 |
| 3,406,455 | 10/1968 | Akin, Jr. | 33/50 |
| 3,491,975 | 1/1970 | Weaver | 248/226 |
| 3,611,606 | 10/1971 | Sefried et al. | 42/1 S |
| 4,026,055 | 5/1977 | Weast | 42/1 ST |
| 4,121,363 | 10/1978 | York | 42/1 ST |

*Primary Examiner*—Charles T. Jordan

*Attorney, Agent, or Firm*—John W. Stuart

[57] ABSTRACT

A telescopic sight mount having a base portion, cap means flexibly connected together at a joint above the center line of the sight mount and connectable to the base portion and tightening means for connecting the cap means to the base portion at a point below the center line of the sight mount is provided.

27 Claims, 8 Drawing Figures

TELESCOPE SIGHT MOUNT

BACKGROUND OF THE INVENTION

This invention relates generally to mounting telescopic sights to firearms and, more specifically, to an improved and more reliable cap design for holding a telescope in a telescopic sight mount.

Telescopic sights are commonly used today to facilitate and improve the accurate aiming of rifles or other firearms at a target. A telescope typically includes an optical system having objective and ocular lens systems and a reticle disposed between the lens systems and at the focal point of the lens system. This reticle is superimposed over an image of the target, thereby eliminating the necessity for a shooter to change eye focus between the sight and the target. The telescope optical system normally provides a magnified target image. The telescope most frequently is an elongate, cylindrical object that sits within appropriately shaped mounting means fastened to the firearm.

The mounting means or telescopic sight mount is fastened to the firearm by screws that fit within the predrilled and pretapped holes in the receiver. The screw receiving holes in the sight mount align with the predrilled and pretapped holes in the firearm's receiver. Thus, once the mount is fastened to the firearm receiver, the telescopic sight may be fastened in place within the sight mount.

The sight mount must permit the telescopic sight to be easily and quickly replaceable. This will facilitate repairing the telescopic sight and make the weapon's sighting more flexible so that telescopic sights of different powers may be employed with the same firearm for different hunting or shooting conditions. The telescopic sight must be replaceable in a manner that is simple and reliable so that the sight may be placed in the exact position and location in the mount on the firearm without the necessity of repeated adjustments. Most importantly, the sight mount must hold the telescopic sight securely during use so that the telescopic sight does not shift and affect the eye relief or change the line of sight of the shooter to the target when firing.

Previous mounts have cap means or a cap portion that fits over and about the telescopic sight and is fastened to the sight mount base in several ways. The ring or cap typically employs screws on both sides of the ring to fasten the ring into the mount. A variation of this employs a clamp-type of arrangement that locks the ring against a projection on one side of the sight mount while the other side of the ring is fastened to the base by screws. Another approach has employed the use of at least one screw that extends generally horizontally through the rings to draw the rings together into the sight mount base at the bottom of the rings. This latter ring system works on a clamping principle that draws the side of the ring into contact with the sides of the telescope.

All of these systems, however, employ a ring or cap means that is unitary about its periphery. Most ring clamps employ connection points to the sight base at the midline of the sight or slightly below so that the only contact with the arcuate periphery of the cylindrical telescope is generally at the top. During use in hunting these types of sight mounts have the potential to lose the secure holding of the telescope when subjected to rugged cross country travel. Typically, when hunting in icy or snowy conditions, or rough mountain terrain, a hunter may slip or otherwise lose footing and accidentally bring the firearm with its telescope into impacting contact with vegetation or the surrounding terrain. This harsh contact can cause the telescope sight to shift its position within the mount, thereby changing the eye relief or the alignment of the telescope sight with the barrel of the firearm, adversely affecting the accuracy of the weapon's aim.

These aforementioned problems, however, are solved in the design of the present invention where a two piece cap is joined at a dovetail joint above the center line of the sight mount so that the dovetail joint is flexible as the individual cap pieces are tightened down to the mount base below the center line of the sight to obtain increased surface area contact with the periphery of the telescope.

SUMMARY OF THE INVENTION

It is an object of the present invention to provide an improved telescopic sight mount for firearms that tightly and securely holds the telescopic sight in position.

It is another object of the present invention to provide a telescopic sight mount with an improved cap that tightens down to the mount base below the center line of the sight mount.

It is a feature of the present invention that the improved cap of the sight mount comprises two pieces that are joined at a flexible joint above the center line of the sight mount.

It is another feature of the present invention that the cap flexes at the joint as the cap is tightened down to the sight mount base to thereby increase the surface contact between the cap and the outer periphery of the telescope tube.

It is another feature of the present invention that the two pieces of the cap are two identical cap halves or pieces joined together by a dovetail joint when assembled.

It is an advantage of the present invention that the improved cap mount is flexible during tightening to hold the telescope tightly and securely without slippage.

It is another advantage of the present invention that the improved cap of the telescope sight mount flexes at the dovetail joint above the center line of the sight mount while the cap halves are tightened to the sight mount base below the center line of the sight mount to thereby obtain increased surface area contact between the outer periphery of the telescope and the sight mount.

These and other objects, features, and advantages are provided in a telescopic sight mount having an improved cap that comprises two pieces joined at a dovetail joint above the center line of the sight mount that is flexible as the individual cap pieces are tightened down to the mount base below the center line of the sight mount.

BRIEF DESCRIPTION OF THE DRAWINGS

The advantages of this invention will become apparent upon consideration of the following detailed disclosure of the invention, especially when it is taken in conjunction with the accompanying drawings wherein:

FIG. 1 is an end elevational view of the telescopic sight mount with a portion partially sectioned through;

FIG. 2 is a side sectional view taken along the lines 2—2 of FIG. 1;

FIG. 3 is a side elevational view of the telescopic mount with a portion of a telescopic sight shown being retained by the cap means and the sight mount base;

FIG. 4 is a top plan view of the telescopic sight mount with a portion of a telescopic sight shown;

DETAILED DESCRIPTION OF THE PREFERRED EMBODIMENT

Figures 1, 2, 3, 4:
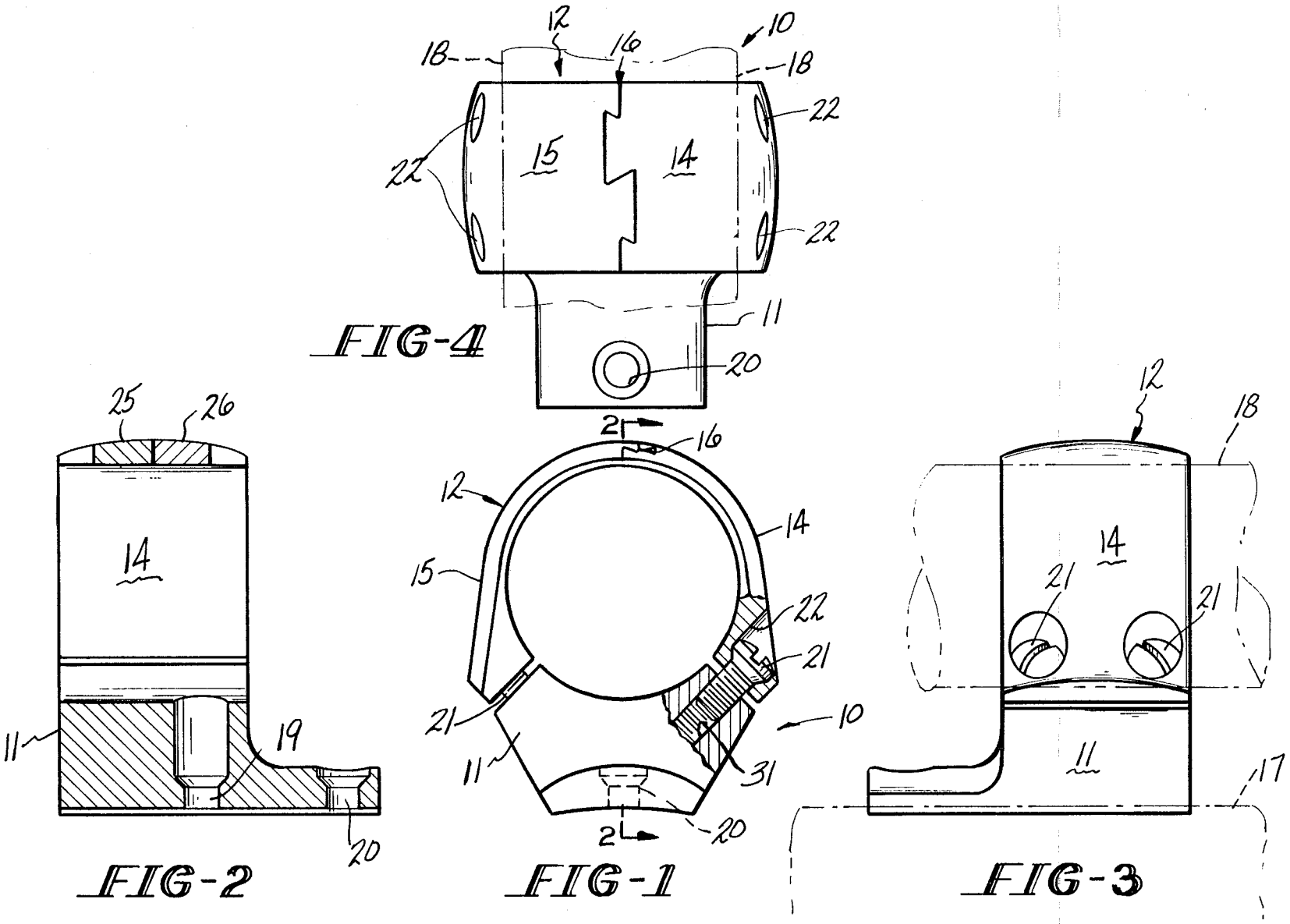
Figure 5:
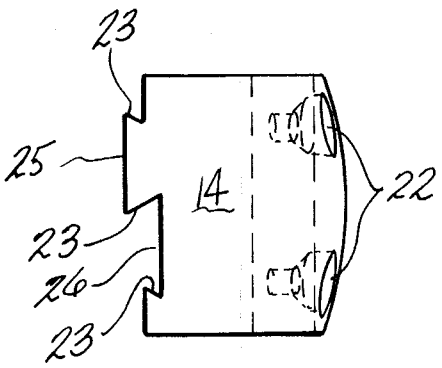
FIG. 5 is a top plan view of one of the pieces or halves of the cap means.
Figure 6:
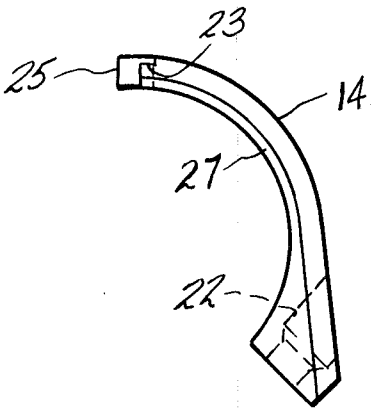
FIG. 6 is an end elevational view of one of the pieces or halves of the cap means.

FIG. 1 shows a telescopic sight mount indicated generally by the numeral 10. Mount 10 has a base portion 11 and cap means indicated generally by the numeral 12. The cap means 12 is comprised of a first cap piece or half 14 and second cap piece or half 15 that are joined at a joint indicated generally by the numeral 16. A fastening means (not shown) is used to secure the telescopic sight mount 10 through the base 11 to a receiver of an appropriate firearm, such as a rifle (not shown). The fastening means (not shown), typically appropriately sized screws, insert into fastening means apertures 19 and 20, as seen in FIG. 2. Tightening means 21, such as appropriately sized screws, secure and tighten the pieces 14 and 15 of the cap means 12 to the base portion 11. The tightening means 21 fit within appropriately sized and recessed tightening means apertures 22, as best seen in FIGS. 1, 3, and 5. Apertures 22 are found in each cap piece or half 14 and 15 of cap means 12, as seen in FIG. 4.

The joint 16 connecting the pieces 14 and 15 of the cap means 12 is known as a dovetail joint. Each piece or half 14 and 15 of joint 16 has a dovetail extending tip 25 and a dovetail tip receiving recess 26, best seen in FIG. 5. Cap pieces 14 and 15 are preferably identical so that they may be made in a single tooling process. Thus, the dovetail extending tip 25 of piece 14 fits within the dovetail tip receiving recess 26 of piece 15 and the dovetail extending tip 25 of the piece 15 fits within the dovetail tip receiving recess 26 of piece 14. Each dovetail extending tip 25 and dovetail tip receiving recess 26 has a pair of obliquely angled surfaces. Cap piece or half 14 has first obliquely angled surfaces 23 which flexibly interlock with the second obliquely angled surfaces 24 of cap half or piece 15.

Figure 8:
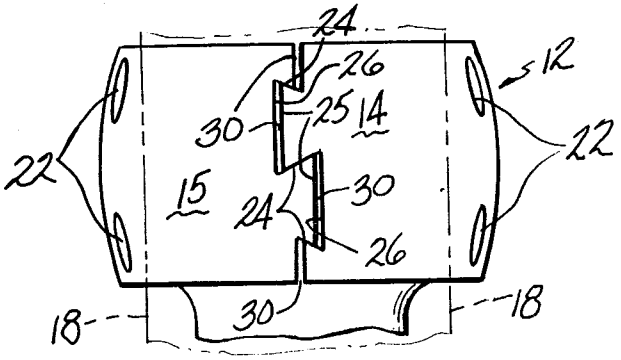
FIG. 8 is a partial top plan view of a telescopic sight mount with a portion of the telescopic sight in position showing the flexing that occurs within the dovetail joint.
Figure 7:
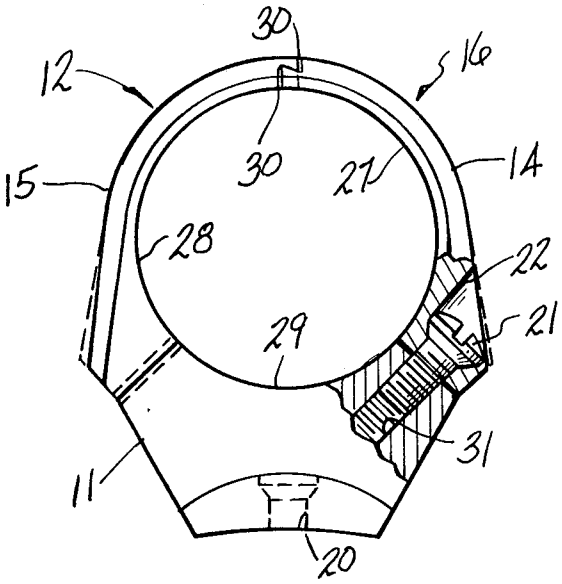
FIG. 7 is an end elevational view of a telescopic sight mount with the cap means tightened completely down showing the flexing that occurs at the dovetail joint above the center line of the mount with the telescopic sight not shown.

As best seen in FIGS. 7 and 8, the cap means 12 tightens down about the outer periphery or tube of the telescopic sight, diagramatically indicated in FIGS. 4 and 8 by the lines numbered 18. Dovetail joint 16 flexes apart by the first obliquely angled surfaces 23 of cap half 14 sliding along the second obliquely angled surfaces 24 of cap half 15. This causes a plurality of gaps 30 to be created between the first cap half 14 and the second cap half 15. Both the first part of the cap means 12 (cap half 14) with its first obliquely angled surfaces 23 and the second part of cap means 12 (cap half 15) with its second obliquely angled surfaces 24 slide along each other until the angled surfaces securely interlock. At this predetermined position, the interlocking of the cap halves 14 and 15 prevent the further separation of each half. This separation and resultant creation of the gaps 30 between the cap pieces, or halves 14 and 15 is caused by the tightening of the tightening means or screws 21 into the screw receiving apertures 31 of the mount base 11, partially seen in FIGS. 1 and 7.

The sight mount 10 has arcuate internal surfaces within which to receive the gun telescopic sight tube 18, partially illustrated in FIGS. 3, 4 and 8. The cap means 12 of FIG. 7 has an arcuate internal periphery 27 on the first part or cap piece 14 and an arcuate internal periphery 28 on the second part or cap piece 15. The mount base 11 has an arcuate internal periphery or surface 29. Thus, as best seen in FIGS. 1 and 7, a completely arcuate or generally circular internal surface is presented by the sight mount 10 in which to retain the telescopic sight tube 18.

In operation, the telescopic sight mount 10 is mounted to a firearm receiver 17, diagramatically illustrated in FIG. 3, by aligning the fastening means apertures 19 and 20 with the predrilled and pretapped holes (not shown) in the top of the firearm receiver 17. Fastening means (not shown) are then inserted into each fastening means aperture 19 and 20 to secure the telescopic sight mount 10 to the firearm. Once thus secured, the tightening means or screws 21 for cap means 12 are loosened on the cap pieces or halves 14 and 15 to permit the cap means 12 to be extended outwardly and the individual cap pieces or halves 14 and 15 to be separated, if necessary. Where a telescopic sight mount 10 is used on a rifle, two sight mounts 10 would be employed, one on the front and the other on the rear of the rifle.

The telescopic sight with its tube 18, as seen in FIG. 3, is inserted through the loosened and opened cap means 12 until the telescopic sight is properly positioned and evenly balanced within the telescopic sight mounts 10 to assure proper eye relief for the firer. It may be necessary, prior to inserting the telescopic sight tube 18, to connect the dovetail joint 16 by inserting the dovetail extending tips 25 into the dovetail tip receiving recesses 26 for cap pieces or halves 14 and 15. This is accomplished by moving the pieces vertically in line over one another and raising the dovetail extending tip 25 and the dovetail tip receiving recess 26 in, for example, cap piece or half 14 upwardly into the dovetail tip receiving recess 26 and dovetail extending tip 25 of, for example, cap piece or half 15.

Once the telescopic sight 18 is properly positioned, the tightening means or screws 21 are screwed into place for both cap pieces or halves 14 and 15. This draws the individual cap pieces 14 and 15 downwardly onto the base portion 11 and causes the cap means 12 to flex at the dovetail joint 16. The flexing permits increased surface area contact to be obtained between the telescopic sight tube 18 and cap means 12 about the internal periphery 27 of the first part of cap means 12 and the internal periphery 28 of the second part of cap means 12. The flexing of the dovetail joint 16 creates distinct gaps 30, best seen in FIGS. 7 and 8, between the cap pieces or halves 14 and 15. During tightening, the first obliquely angled surfaces 23 of first cap piece or half 14 slide outwardly along the second obliquely angled surfaces 24 of second cap piece or half 15 to create the gaps 30, while the remaining portions of the first and second obliquely angled surfaces 23 and 24 flexibly interlock and cannot move outwardly apart from each other any further. At this point, the telescopic sight tube 18 is retained firmly in place so that no slippage or movement of the sight within the cap means 12 of telescopic sight mount 10 can occur and, because of the nature of the dovetail joint 16, overtorquing of the telescopic sight tube 18 out of proper vertical alignment is also avoided.

While the preferred structure in which the principles of the present invention have been incorporated as shown and described above, it is to be understood that the invention is not to be limited to the particular details thus presented, but in fact, widely different means may be employed in the practice of the broader aspects of this invention. The scope of the appended claims is intended to encompass all obvious changes in the details, materials, and arrangements of parts which will occur to one of skill in the art upon a reading of the disclosure.

I claim:

1. A telescopic sight mount having a center line midway between the top and the bottom of the sight mount removably fastenable to a firearm receiver for retaining a telescopic sight comprising in combination:

a. a base portion connectable to the firearm receiver;

b. fastening means for selectively fastening the base portion to the firearm receiver;

c. cap means flexibly connected together at a joint above the center line of the sight mount and connectable to the base portion, the cap means comprising a first part and a second part connectable to the base portion at a point below the center line of the sight mount, and the joint connects the first part and the second part above the center line of the sight and is dovetailed so that the first part flexibly interlocks with the second part along first obliquely angles surfaces on the first part and second obliquely angles surfaces on the second part; and d. tightening means for connecting the cap means to the base portion at a point below the center line of the sight mount.

2. The apparatus according to claim 1 wherein the base portion has a plurality of screw receiving apertures therein to fasten the cap means thereto.

3. The apparatus according to claim 2 wherein the first part and the second part of the cap means each have at least one screw aperture therethrough in line with corresponding screw receiving apertures in the base portion.

4. The apparatus according to claim 3 wherein the tightening means further comprises at least one screw for each of the first part and the second part of the cap means to securely fasten the cap means to the base portion thereby causing portions of the first obliquely angled surfaces and portions of the second obliquely angled surfaces to flex apart to create a plurality of gaps between the first part and the second part of the cap means while the remaining portions of the first and second obliquely angled surfaces remain flexibly interlocked at the joint.

5. The apparatus according to claim 4 wherein the first part and the second part of the cap means each have an inner periphery and an outer periphery, at least the inner periphery being arcuate.

6. The apparatus according to claim 5 wherein the base portion further has an inner surface that is arcuate.

7. The apparatus according to claim 6 wherein the inner surface of the base portion and the inner periphery of the first part and the second part of the cap means collectively define a generally circular surface when assembled.

8. A telescopic sight mount having a center line midway between the top and the bottom of the sight mount for retaining a telescopic sight comprising in combination:

a. base portion;

b. cap means flexibly connected together at a joint above the center line of the sight mount and connectable to the base portion, the cap means comprising a first part and a second part connectable to the base portion at a point below the center line of the sight mount, and the joint connects the first part and the second part and is dovetailed so that the first part flexibly interlocks with the second part along first obliquely angled surfaces on the first part and second obliquely angled surfaces on the second part; and c. tightening means for connecting the cap means to the base portion at a point below the center line of the sight mount so that when tightened the cap means flexes at the joint.

9. The apparatus according to claim 8 wherein the first part and the second part of the cap means each have at least one screw aperture therethrough in line with screw receiving apertures in the base portion.

10. The apparatus according to claim 9 wherein the tightening means further comprises at least one screw for each of the first part and the second part of the cap means to securely fasten the cap means to the base portion thereby causing portions of the first obliquely angled surfaces and the second obliquely angled surfaces to flex apart to create a plurality of gaps between the first part and the second part of the cap means while the remaining portion of the first and second obliquely angled surfaces remain flexibly interlocked at the joint.

11. The apparatus according to claim 10 wherein the first part and the second part of the cap means each have an inner periphery and an outer periphery, at least the inner periphery being arcuate.

12. The apparatus according to claim 11 wherein the base portion further has an inner surface that is arcuate.

13. The apparatus according to claim 12 wherein the inner surface of the base portion and the inner periphery of each of the first part and the second part of the cap means collectively define a generally circular surface when assembled.

14. The apparatus according to claim 13 wherein the telescopic sight mount further is adapted to receive and retain a telescopic sight between the cap means and the base portion.

15. The apparatus according to claim 14 wherein the telescopic sight mount further is removably fastenable to a firearm receiver by fastening means.

16. The apparatus according to claim 15 wherein the base portion further comprises at least one aperture through which the fastening means removably fasten the telescopic sight mount to the firearm receiver.

17. A telescopic sight mount having a center line midway between the top and the bottom of the sight mount for retaining a telescopic sight comprising in combination:

a. a base portion;

b. cap means comprising a first part and a second part flexibly connected together at a dovetailed joint above the center line of the sight mount and connectable to the base portion; and c. tightening means for connecting the cap means to the base portion so that when tightened the cap means flexes at the joint.

18. The apparatus according to claim 17 wherein the cap means further is connectable to the base portion at a point below the center line of the sight mount.

19. The apparatus according to claim 18 wherein the dovetailed joint further comprises first obliquely angled surfaces on the first part of the cap means and second obliquely angled surfaces on the second part of the cap means so that the first part flexibly interlocks with the second part along the first obliquely angled surfaces and the second obliquely angled surfaces.

20. The apparatus according to claim 19 wherein the first part and the second part of the cap means each have at least one screw aperture therethrough in line with screw receiving apertures in the base portion.

21. The apparatus according to claim 20 wherein the tightening means further comprises at least one screw for each of the first part and the second part of the cap means to securely fasten the cap means to the base portion thereby causing portions of the first obliquely angled surfaces and the second obliquely angled surfaces to flex apart to create a plurality of gaps between the first part and the second part of the cap means while the remaining portion of the first and second obliquely angled surfaces remain flexibly interlocked at the joint.

22. The apparatus according to claim 21 wherein the first part and the second part of the cap means each have an inner periphery and an outer periphery, at least the inner periphery being arcuate.

23. The apparatus according to claim 22 wherein the base portion further has an inner surface that is arcuate.

24. The apparatus according to claim 23 wherein the inner surface of the base portion and the inner periphery of each of the first part and the second part of the cap means collectively define a generally circular surface when assembled.

25. The apparatus according to claim 24 wherein the telescopic sight mount further is adapted to receive and retain a telescopic sight between the cap means and the base portion.

26. The apparatus according to claim 25 wherein the telescopic sight mount further is removably fastenable to a firearm receiver by fastening means.

27. The apparatus according to claim 26 wherein the base portion further comprises at least one aperture through which the fastening means removably fasten the telescopic sight mount to the firearm receiver.

* * * * *